US005867917A

United States Patent [19]

Karon

[11] Patent Number: 5,867,917

[45] Date of Patent: Feb. 9, 1999

[54] PICTURE HANGER LOCATING DEVICE

[76] Inventor: Daniel R. Karon, 1 E. Delaware Pl., # 10B, Chicago, Ill. 60611

[21] Appl. No.: 769,791

[22] Filed: Dec. 19, 1996

[51] Int. Cl.[6] ..... G01B 3/00

[52] U.S. Cl. ..... 33/613; 33/666

[58] Field of Search ..... 33/613, 666, 668; 248/547; 81/489

[56] References Cited

U.S. PATENT DOCUMENTS

| | | | |
|---|---|---|---|
| 4,382,337 | 5/1983 | Bendick | 33/613 |
| 4,455,756 | 6/1984 | Greene | 33/613 |
| 4,517,860 | 5/1985 | Dameron, Jr. . | |
| 4,559,690 | 12/1985 | Asmus . | |
| 4,753,014 | 6/1988 | Vrajich | 33/613 |
| 4,893,776 | 1/1990 | Floyd | 33/666 |
| 5,109,611 | 5/1992 | Houck | 33/666 |
| 5,129,154 | 7/1992 | Aydelott | 33/666 |
| 5,180,135 | 1/1993 | Hindall | 33/666 |
| 5,471,760 | 12/1995 | Farris | 33/613 |

OTHER PUBLICATIONS

Stots Corporation Picture Hanging Tool, packaging copyright notice 1986.

*Primary Examiner*—G. Bradley Bennett

*Attorney, Agent, or Firm*—Silverman, Cass & Singer, Ltd.

[57] ABSTRACT

A picture hanger locating device for use with a picture having a hanging cord positioned on the rear thereof intended to be disposed over a hook or like member to be secured to a wall behind the desired location of the picture. A cord tensioning member is adapted to be removably positioned at a first end thereof over the upper peripheral edge of the picture and at a second end spaced from said first end in communication with the cord to move the same to the tensioned position the cord will assume when the cord is disposed over the hook member. A wall marking device is secured to the second end facing away from the rear of the picture and toward the wall to mark the wall at the location along the length of the cord where the hook member should be placed to engage the cord when the picture is hung on the wall.

12 Claims, 1 Drawing Sheet

PICTURE HANGER LOCATING DEVICE

BACKGROUND OF THE INVENTION

1. Field of the Invention

This invention relates generally to picture hanger locating devices, and more particularly, to such devices for marking a wall at the location behind a picture where a hook is to be positioned to hang the picture at its desired location.

2. Description of the Prior Art

Devices for marking the location on a wall where a picture hanging hook is to be positioned are known. Such devices are required because pictures usually are hung by positioning a rear-mounted cord over a wall-inserted hook or the like which is located behind the picture itself. When positioning the picture to be hung, the picture usually is held against the wall at the desired hanging location and then a mark is made on the wall behind the picture to indicate the location for placement of the hook over which the cord is to be positioned.

Without the use of appropriate location marking devices, the picture hanging process usually requires a frustrating trial and error procedure of estimating the location for placement of the hook and then positioning the cord over the located hook and seeing if the location is where desired. Since the cord mounted to the rear of the picture usually is stretched to a tensioned location when in position on the hook by reason of the weight of the picture, it is not uncommon for errors in placement of the hook to occur and the resultant picture hanging location being different than that which was desired. Thus, the hook-locating procedure must be repeated to adjust the hook placement on the wall and correct the error which resulted because of the difficulty in correctly estimating the desired location of the picture after it is hung. It is not uncommon for several hook-placement actions to be needed before the desired picture-hanging location is achieved. In addition to the frustration of such repeated procedure, the erroneous placement of hooks leaves unnecessary holes in the wall.

One reason for difficulty in accurately locating a picture hanging hook behind a picture having a rear-mounted hanging cord is that until the picture is hung in place on the wall-mounted hook, the cord is not stretched to the tensioned position it will assume when so hung. Therefore, in order accurately to position the wall-mounted hook at its desired location, the cord must first be stretched to its tensioned position and means provided to mark the wall at the location where the hook will engage the tensioned cord at the wall mounted position of the picture.

Prior art devices are not known to enable the desired accurate marking of a wall at the location thereof where a hook should be positioned to engage a tensioned cord on the rear of a picture so as accurately to place the picture at its desired hanging location. It therefore is desirable to provide such a picture hanger locating device which conveniently stretches a rear-mounted picture hanging cord to the location it will assume when the picture is mounted to a hook on a wall with the cord engaged over the hook, and then to mark the wall at said location to indicate where the hook should be inserted in the wall to hang the picture at the desired location.

SUMMARY OF THE INVENTION

The invention is characterized by a cord tensioning member adapted to be removably positioned between the top peripheral edge of a picture or the like and in engagement with a hanging cord affixed to the rear of the picture. The tensioning member moves the cord to the tensioned location it will assume when the picture is hung on a wall by engagement of the cord over a hook to be positioned on the wall. A marker facing away from the rear of the picture is secured to the tensioning member at the location where it engages the cord. Placement of the picture against a wall to which it is to be mounted causes the marker to mark the wall at the location where a picture-hanging hook is to be located for desired hanging of the picture on the wall.

DESCRIPTION OF THE PREFERRED EMBODIMENT

Figures 1, 2, 3, 4, 5, 6, 7, 8, 9:
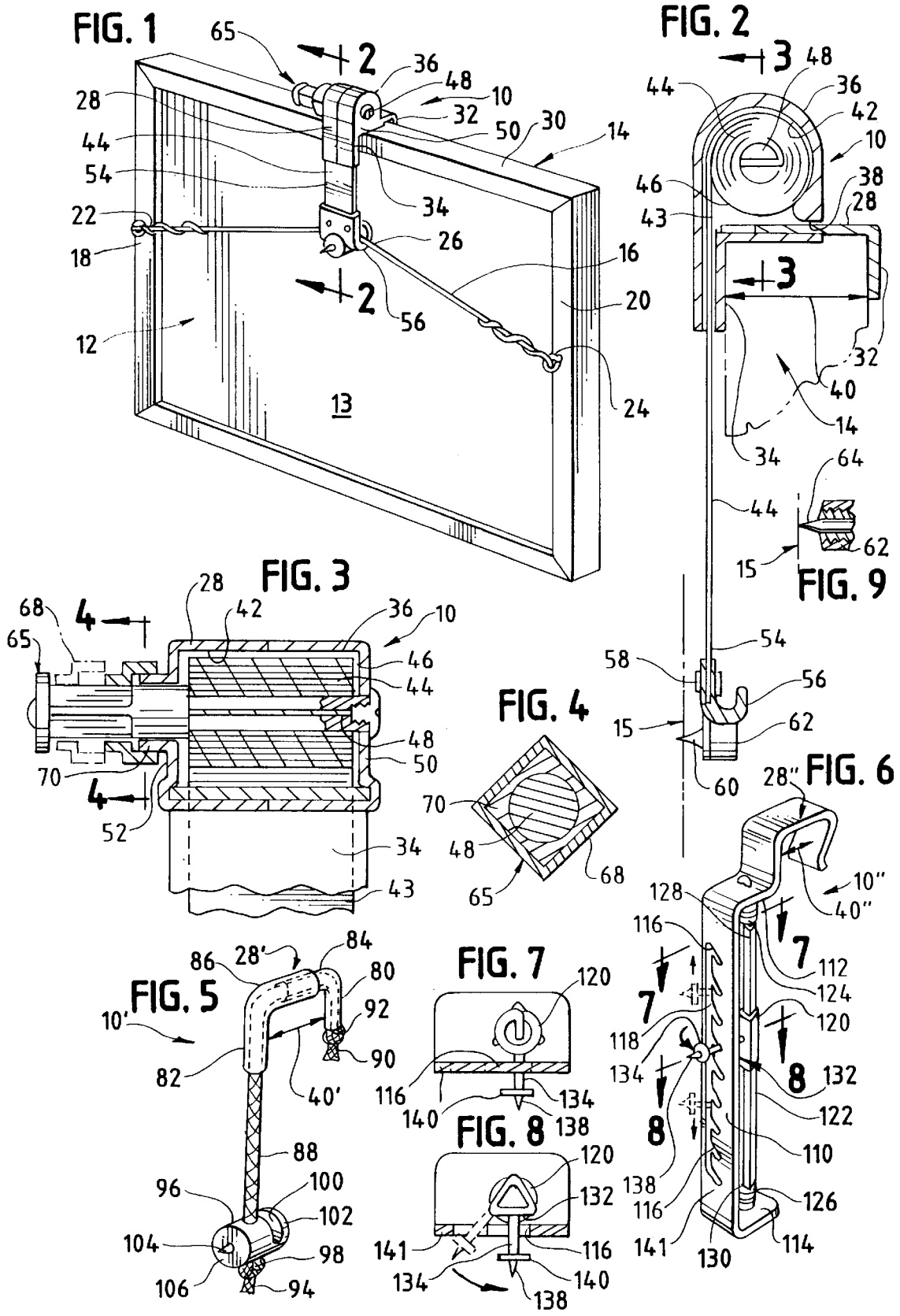
FIG. 1 is a perspective view of the device of the invention positioned on the rear of a picture in hanger locating orientation.
FIG. 2 is a sectional view taken along the line 2—2 of FIG. 1 in the direction indicated generally.
FIG. 3 is a sectional view taken along the line 3—3 of FIG. 2 in the direction indicated generally.
FIG. 4 is a sectional view taken along the line 4—4 of FIG. 3 in the direction indicted generally.
FIG. 5 is a perspective view of an alternate embodiment of the invention incorporating a stretchable cord.
FIG. 6 is a perspective view of a further alternate embodiment of the invention incorporating a slot positioning member for the marker.
FIG. 7 is a sectional view taken along the line 7—7 of FIG. 6 in the direction indicated generally.
FIG. 8 is a sectional view taken along the line 8—8 of FIG. 6 in the direction indicated generally.
FIG. 9 is a sectional view showing an alternate marker for use with the device of the invention.

Referring to FIGS. 1–4, a picture hanger locating device 10 is shown in conjunction with the rear side 13 of a picture 12 which may, but need not necessarily include a frame 14. Picture frame 14 includes a hanging cord 16 secured at opposite vertical side posts 18,20 in conventional manner, such as by screw eyes 22,24. Cord 16 also is conventional and may typically be formed of wire, rope, plastic or the like.

Cord 16 is shown in FIG. 1 in its tensioned position in which the proximate central location 26 is disposed in a plane elevated from the plane in which screw eyes 22,24 are located. The illustrated tensioned position of cord 16 is the same generally as that which it would assume when it is positioned over a picture hanging hook (not shown) affixed to a wall 15 (FIG. 2) on which picture 12 is intended to be displayed. When not so positioned on a picture hanging hook or protrusion, cord 16 will be in relaxed, non-tensioned position (not shown) at a disposition other than that shown in FIG. 1.

The tensioned and relaxed positions of cord 16, as well as its orientation when positioned over a hook placed in a wall, are well-known conventional features of such cords, as are picture hanging hooks which can take the form of return-bent members, nails, screws or the like for securement in a wall. The specific characteristics of such cords and hooks do not form a part of the present invention which is adapted to function with any variation thereof.

Picture hanger locating device 10 includes a generally C-shaped frame engagement member 28 adapted to be removably positioned over the upper peripheral edge 30 of frame 14. Member 28 includes a first leg 32 intended to be disposed proximate the front side of the picture 12 opposite the rear side 13 thereof, as seen in FIG. 1. A second leg 34 of member 28 is disposed generally parallel to the first leg 32 and is disposed proximate the rear side 13. Second leg 34 is formed as an extension of housing 36 of member 28, which includes a slot 38 in which first leg 32 is adjustably movable towards and away from second leg 34 to change the dimension of distance 40 between legs 32 and 34. In this manner, member 28 may adjustably be positioned upon a variety of frames 14 having a range of cross-sectional sizes and configurations by moving leg 32 closer to or further away from leg 34 to fit over the frame 14. Friction engagement of leg 32 in slot 38 prevents the leg from unintentionally slipping out of engagement with frame 14.

Housing 36 retains in a compartment 42 thereof one end 43 of a spring, illustrated for example as leaf spring 44, wound upon a spool 46 rotatably secured upon pin 48 passing through oppositely oriented sides 50, 52 of the housing. The specific configuration of leaf spring 44 is for purposes of illustration only; any of a wide variety of springs may be useable with the invention. The opposite end 54 of spring 44 is secured to return-bent hook part 56 by fastener 58. A wall marking device, such as pin 60, is retained in housing 62 affixed to hook part 56, and is arranged to face away from the rear side 13 of picture 12. Alternate marking device 64 is a pencil or pen point which can be secured in housing 62 in friction-fit or other conventional manner.

In use, frame engagement member 28 is positioned over upper peripheral edge 30 of frame 14 by sliding legs 32, 34 together. Spring 44 is unreeled from spool 46 along the rear side 13 of picture 12 to a length permitting hook part 56 to be engaged upon cord 16 at the proximate central location 26 thereof where the cord is intended to be engaged upon a hook (not shown) for hanging the picture to a wall. Spring 44 next is reeled back upon spool 46 by turning spring-adjustment knob 65 which is connected to pin 48 external of housing 36. Spring 44 is reeled back a sufficient distance to move cord 16 to its tensioned position shown in FIG. 1 with proximate central location 26 disposed in a plane elevated from that of screw eyes 22,24. This tensioned position is approximately the same as that which cord 16 will assume when it is placed over a wall hook for intended display of picture 12.

The tensioned position of spring 44 is maintained by locking adjustment knob 65 to prevent further rotation. This is accomplished by reason of the square-shaped cross-sectional configuration of knob 65 best seen in FIG. 4. In order to move knob 65, overlaying portion 68 is moved axially with respect to pin 48, thus freeing it from matingly engagable extension part 70 of housing 36 (shown in dotted line in FIG. 3). Portion 68 is locked in position when spring 44 is moved to its cord tensioning position by moving said portion back into engagement with part 70, as shown in solid line in FIG. 3.

After locating device 10 is positioned on frame 14 with hook part 56 engaged on cord 16 and moved to its tensioned position shown in FIG. 1, the picture 12 is placed adjacent wall 15 at its intended display location. Rear side 13 then can be pressed against the wall, thus causing pin 60 or pencil point 64 to mark the wall at the location where a hook should be positioned in order to hang the picture at its desired location. Locating device 10 then is removed from frame 14 by releasing spring 44 by movement of adjustment knob 65, and hook part 56 is released from cord 16. Leg 32 next is moved out of engagement with frame 14 to free the locating device from the frame. Picture 12 then can be hung on the hook to be inserted in the wall at the marked location by engagement of cord 16 over the located hook.

In instances where heavy pictures are desired to be hung on a wall by placement of two or more hooks, more than one locating device 10 can be used in similar manner by following the above procedure at more than one location along the length of cord 16 between screw eyes 22, 24.

An alternatively constructed picture hanging device 10' is shown in FIG. 5. Device 10' includes generally C-shaped frame engagement member 28' formed of a pair of hollow tubular L-shaped legs 80,82. One portion 84 of leg 80 is slidably retained within a portion 86 of leg 82 so that the legs 80, 82 are movable toward or away from each other to adjust the dimension of distance 40' between portions 84, 86.

An elastic cord 88 is passed through the interstices of legs 80, 82 and one end 90 thereof is prevented from removal from the legs by knot 92 tied thereon. The second end 94 of cord 88 is extended a distance beyond the legs 80, 82 and terminates in a passageway provided in housing 96, with a knot 98 tied in cord 88 below housing 96 to prevent end 94 from removal from the housing. Housing 96 has a slot 100 formed on one surface 102 thereof, and wall marking device such as pin 104 is retained on another surface 106 thereof.

The general configuration of housing 96 shown in FIG. 5 is for purposes of illustration only. Alternatively, the hook part 56 shown in FIGS. 1 and 2 could be adapted for use with the embodiment of FIG. 5 by substitution thereof with housing 96. In such case, cord 88 would be affixed to hook part 56 by a fastener, such as fastener 58.

In use of device 10', legs 80, 82 are positioned over edge 30 of frame 14 are adjusted one with respect to the other to set the dimension of distance 40' so that the legs engage the frame. Elastic cord 88 then is stretched to a position in which slot 100 engages cord 16 proximate central location 26 thereof, with pin 104 facing away from rear side 13 of picture 12. Cord 88 is then permitted to move toward its relaxed position with picture hanging cord 16 moved to its tensioned position while retained in slot 100. Picture 12 then is placed adjacent wall 15 at its intended display location. Rear side 13 is pressed against the wall to mark same at the location where a wall hanging hook should be placed to hang the picture at its desired location.

Removal of device 10' from picture 12 is accomplished by again stretching cord 88 to release picture hanging cord 16 from slot 10 in housing 96, and sliding legs 80, 82 away from each other to release member 28' from the frame.

A further alternatively constructed picture hanging device 10" is shown in FIGS. 6–8. Device 10" includes a generally C-shaped frame engagement portion 28", preferably formed of resilient material so that portion 28" can be engaged over frame 14 in clamp-like fashion. By reason of the resiliency of portion 28", the dimension of distance 40" is variable to enable the device 10" to be used with frames of variant sizes.

Device 10" includes an extension leg 110 which depends from frame engagement portion 28". Extension leg 110 has an upper bearing surface 112 affixed to frame engagement portion 28" and a lower bearing surface 114 spaced from upper bearing surface 112. A plurality of slots 116 are spaced at intervals along the length of extension leg 110 and open to edge 118, but terminate within the leg 110 along the elongate length thereof. The slots 116 are arranged at an angle to normal so that the open ends along edge 118 are disposed in planes which are higher than the respective termination ends within leg 110.

A slider 120 is movably positioned along rail 122 which is retained between bearing surfaces 112,114. Centering springs 124,126 are positioned at opposite ends 128,130 of rail 122 and engage between respective bearing surfaces 112, 114 and the ends 128,130. By reason of the action between springs 124,126 and bearing surfaces 112,114, rail 122 is rotatable along its axial length to move surface 132 of slider 120 towards or away from leg 110.

An extension finger 134 is formed on surface 132 of slider 120 and is adapted for engagement with any selected slot 116 along the length of leg 110 by movement of slider along the length of rail 122 and rotating rail 122 against the force of springs 124,126 (as seen in dotted line in FIG. 8), then releasing same to permit the rail to assume the position shown in solid line in FIG. 8, and also in FIGS. 6 and 7, with finger 134 engaged in a selected slot 116.

A wall marking device, such as pin 138, is formed on the free end 140 of finger 134. Pin 138 faces away from rear surface 13 of picture 12 when device 10" is positioned on frame 14.

In use of device 10", frame engagement portion 28" is engaged over upper edge 30 of frame 14. Picture hanging cord 16 is engaged over finger 134 adjacent the outwardly-facing surface 141 of leg 110. Rail 122 is rotated to move finger 134 carried on slider 120 out of engagement with a slot 116. Slider 120 is then moved along rail 122 to a location at which cord 16 is stretched to its tensioned location. Slider 120 then is pivoted back to the location illustrated in FIG. 1 and finger 134 is positioned within the closest slot 116 where finger 134 is retained until wall marking is completed. Picture 12 is then placed against wall 15 at its intended display location. Rear side 13 is passed against the wall to mark the same by pin 138 pressed thereagainst.

Removal of device 10" from picture 12 is accomplished by pivoting rail 122 to move finger 134 out of slot 116 and thereby releasing the tension on cord 16. Upon disengagement of the cord 16 from finger 134, frame engagement portion 28" may be removed from frame 14.

Modifications and variations of the present invention are possible in light of the above teachings. It is to be understood that within the scope of the appended claims, the invention may be practiced other than as specifically described.

I claim:

1. A picture hanger locating device for use with a picture having a rear surface and a hanging cord positioned adjacent to said rear surface, the hanging cord intended to be disposed over a hanging protrusion engaged in a wall at a desired location on said wall for hanging the picture, said device comprising, a cord tensioning member for removable positioning at a first end thereof over a top peripheral edge of the picture, a second end of said cord tensioning member spaced from said first end, said second end including cord engagement means to engage the cord and move the same to a tensioned position thereof which the cord will assume when it is disposed over said hanging protrusion, and a wall marker secured to the cord tensioning member proximate said second end, a retractable spring disposed between said first and second ends, said spring being retained in coiled condition at said first end, and a return-bent hook part secured to said second end to engage said cord and move it to its tensioned position, whereby placement of the picture against the wall causes the marker to mark the wall at the location where the hanging protrusion is to be located for hanging the picture on the wall.

2. A device as claimed in claim 1 in which said spring is retained at said first end in a housing having oppositely facing legs adjustably movable towards and away from each other.

3. A device as claimed in claim 2 in which said wall marker is a pin secured in a housing.

4. A device as claimed in claim 2 in which said spring is wound upon a spool retained in said housing, said spring being adjustably movable upon said spool to increase or decrease the tension exerted on said cord.

5. A picture hanger locating device for use with a picture having a rear surface and a hanging cord positioned adjacent to said rear surface, the hanging cord intended to be disposed over a hanging protrusion engaged in a wall at a desired location on said wall for hanging the picture, said device comprising, a hanging cord tensioning member for removable positioning at a first end thereof over a top peripheral edge of the picture, a second end of said hanging cord tensioning member spaced from said first end, a joining cord disposed between said first and second ends, said second end including hanging cord engagement means to engage the hanging cord and move the same to a tensioned position thereof which the hanging cord will assume when it is disposed over said hanging protrusion, and a wall marker secured to the hanging cord tensioning member proximate said second end, whereby placement of the picture against the wall causes the marker to mark the wall at the location where the hanging protrusion is to be located for hanging the picture on the wall.

6. A device as claimed in claim 5 in which said joining cord is elastic.

7. A device as claimed in claim 5 in which said joining cord is retained at said first end by an angular member having a pair of legs.

8. A device as claimed in claim 7 in which said angular member is of generally C-shaped configuration.

9. A device as claimed in claim 8 in which said angular member is tubular and said legs are adjustably movable towards and away from each other.

10. A picture hanger locating device for use with a picture having a rear surface and a hanging cord positioned adjacent to said rear surface, the hanging cord intended to be disposed over a hanging protrusion engaged in a wall at a desired location on said wall for hanging the picture, said device comprising, a cord tensioning member for removable positioning at a first end thereof over a top peripheral edge of the picture, a second end of said cord tensioning member spaced from said first end, said second end including cord engagement means to engage the cord and move the same to a tensioned position thereof which the cord will assume when it is disposed over said hanging protrusion, and a wall marker secured to the cord tensioning member proximate said second end, an extension leg disposed between said first and second ends, said extension leg including a plurality of slots, and an extension finger carried on said extension leg for engagement within a selected slot to retain said hanging cord in said tensioned position, whereby placement of the picture against the wall causes the marker to mark the wall at the location where the hanging protrusion is to be located for hanging the picture on the wall.

11. A device as claimed in claim 10 in which said extension finger is carried on a slider movable adjacent to said extension leg along the elongate length thereof.

12. A device as claimed in claim 10 in which said wall marker is formed on a free end of said finger.

* * * * *